US008444541B2

(12) United States Patent
Horbach et al.

(10) Patent No.: US 8,444,541 B2
(45) Date of Patent: May 21, 2013

(54) SOLID-BOWL CENTRIFUGE HAVING A LIQUID DISCHARGE SEALED SUCH THAT A POND LEVEL IN A SEPARATION SPACE REMAINS UNCHANGED WHEN PRESSURIZATION OCCURS

(75) Inventors: Ulrich Horbach, Hamm (DE); Tore Hartmann, Oelde (DE); Knud Schöneberg, Stade (DE)

(73) Assignee: GEA Mechanical Equipment GmbH, Oeide (DE)

( * ) Notice: Subject to any disclaimer, the term of this patent is extended or adjusted under 35 U.S.C. 154(b) by 869 days.

(21) Appl. No.: 12/278,942

(22) PCT Filed: Feb. 7, 2007

(86) PCT No.: PCT/EP2007/051175

§ 371 (c)(1),
(2), (4) Date: Oct. 7, 2009

(87) PCT Pub. No.: WO2007/090849

PCT Pub. Date: Aug. 16, 2007

(65) Prior Publication Data

US 2010/0041535 A1 Feb. 18, 2010

(30) Foreign Application Priority Data

Feb. 10, 2006 (DE) ..... 10 2006 006 178

(51) Int. Cl.
*B04B 1/20* (2006.01)

(52) U.S. Cl.
USPC ..... 494/10; 494/25; 494/26; 494/37; 494/53; 494/56

(58) Field of Classification Search
USPC ..... 494/23, 25, 26, 53, 54, 56, 67, 10, 494/37; 210/380.1, 380.3
See application file for complete search history.

(56) References Cited

U.S. PATENT DOCUMENTS

| | | | | | |
|---|---|---|---|---|---|
| 3,795,361 | A | * | 3/1974 | Lee | 494/26 |
| 3,885,734 | A | * | 5/1975 | Lee | 494/25 |
| 4,245,777 | A | * | 1/1981 | Lavanchy | 494/53 |
| 4,790,806 | A | * | 12/1988 | High | 494/26 |
| 5,176,616 | A | * | 1/1993 | Schlip et al. | 494/37 |
| 5,244,451 | A | * | 9/1993 | Retter | 494/37 |

(Continued)

FOREIGN PATENT DOCUMENTS

| | | |
|---|---|---|
| DE | 30 22 148 A1 | 1/1981 |
| DE | 40 33 012 A1 | 4/1992 |

(Continued)

*Primary Examiner* — Charles E Cooley
(74) *Attorney, Agent, or Firm* — Barnes & Thornburg LLP

(57) ABSTRACT

A solid-bowl screw centrifuge includes a rotatable drum having a horizontal axis of rotation, which drum surrounds a centrifuging space. Further included is a screw which is arranged within the drum, the screw being rotatable at a different speed relative to the drum. Further included is at least one liquid discharge sealed from its surroundings and at least one solid discharge in a tapering region of the drum. Also included is an immersion disk on the screw which disk lies between a liquid feed and the solid discharge and divides the centrifuging space into a discharge space between the immersion disk and the solid discharge, and a separation space between the immersion disk and the liquid discharge. The centrifuge includes a device for charging the separation space with a gas. A process for operating for the solid-bowl centrifuge is also disclosed.

21 Claims, 2 Drawing Sheets

U.S. PATENT DOCUMENTS

| | | | | |
|---|---|---|---|---|
| 6,749,552 | B1 * | 6/2004 | Figgener et al. | 494/53 |
| 7,056,273 | B2 * | 6/2006 | Ostkamp et al. | 494/27 |
| 7,510,519 | B2 * | 3/2009 | Reichenbach et al. | 494/57 |
| 2005/0227848 | A1 * | 10/2005 | Ostkamp et al. | 494/53 |
| 2008/0153687 | A1 * | 6/2008 | Reichenbach et al. | 494/56 |
| 2010/0041535 | A1 * | 2/2010 | Horbach et al. | 494/5 |
| 2010/0105536 | A1 * | 4/2010 | Sudhues et al. | 494/26 |
| 2011/0009253 | A1 * | 1/2011 | Pomerleau | 494/23 |
| 2011/0039680 | A1 * | 2/2011 | Madsen | 494/56 |

FOREIGN PATENT DOCUMENTS

| | | | |
|---|---|---|---|
| DE | 43 20 265 | A1 | 12/1994 |
| DE | 198 30 653 | C1 | 11/1999 |
| DE | 102 23 802 | A1 | 12/2003 |
| EP | 640398 | A2 * | 3/1995 |
| JP | 09094485 | A * | 4/1997 |
| JP | 10286492 | A * | 10/1998 |
| WO | WO 2006133804 | A1 * | 12/2006 |

* cited by examiner

SOLID-BOWL CENTRIFUGE HAVING A LIQUID DISCHARGE SEALED SUCH THAT A POND LEVEL IN A SEPARATION SPACE REMAINS UNCHANGED WHEN PRESSURIZATION OCCURS

BACKGROUND AND SUMMARY

The present disclosure relates to a solid-bowl screw centrifuge and to a process for operation of the solid-bowl screw centrifuge. The solid-bowl screw centrifuge includes a rotatable drum having a horizontal axis of rotation, which drum surrounds a centrifuging space which tapers at least in a portion. Further included is a screw which is arranged in the drum and is rotatable at a differential speed in relation to the drum. Also included is at least one solid-material discharge in the tapering region of the drum and an immersion disk on the screw. The immersion disk lies between a liquid feed and the solid-material discharge and subdivides the interior drum space or centrifuging space into a discharge space between the immersion disk and the solid-material discharge and a separating space between the immersion disk and the liquid discharge. The centrifuge also includes a device for admitting a gas to the separation space.

As noted above, the solid-bowl screw centrifuge, also known as a decanter, is provided with a rotatable drum. The solid-bowl screw centrifuge has a cylindrical portion and the tapering portion which is tapered conically. As also noted, arranged in the drum is a screw, which during operation rotates at a differential speed in relation to the drum.

In the decanter drum, an added suspension is separated into a liquid phase and a solid phase as a result of the centrifugal effect. At the same time, the solid material moves outward toward the inner wall of the drum, where it forms an annular layer. The differential motion between the drum and the screw causes conveyance of the solid material axially in the cylindrical part of the drum. In the conical part of the drum, radial conveyance is also required, counter to the acting centrifugal force.

Such a structural design is shown, for example, by DE 43 20 265 A1. In the design shown in this document, the distance between a weir for liquid discharge and a throttling disk can be changed by turning a threaded bushing. The accompanying changing of the outflow cross-section brings about a change in the liquid level in the centrifuging drum, so that an infinitely variable setting of this liquid level is possible by displacing the throttling disk.

It is known from DE 198 30 653 C1 that the liquid discharge of an open solid-bowl screw centrifuge occurs by a peeling disk. Downstream of the peeling disk there is a labyrinth seal to return product droplets to the peeling disk. According to this design, there is no need for sealing from the space outside.

A solid-bowl screw centrifuge in which the product space is sealed from the outside is disclosed by DE 102 23 802 B4. A barrier chamber with a barrier fluid feed in combination with an immersion disk and a siphon disk make it possible in this design for the centrifuging chamber to be sealed from the surrounding atmosphere. Although the design itself has proven successful, it is only conditionally suitable for the processing of products in which the solid material to be discharged or the phase to be discharged at the conical end is of relatively low viscosity.

See also DE 40 33 012 A1 and DE 30 22 148 A1.

It is also known, in the case of some types of decanters to measure the torque between the screw and the drum that is necessary for conveyance and to use this as an indicator of the amount of solid material located in the drum. If the decanter is appropriately equipped, for example, a two-gear drive or comparable drive, it is possible to regulate the differential speed in dependence on the measured torque in such a way that a largely constant degree of filling with solid material in the decanter can be set.

The mechanical conveyance by the screw is based substantially on force transmission by internal friction. The extent to which mechanical conveyance is possible, therefore, depends on the rheological properties of the solid-material composition.

FIG. 2 schematically illustrates the shearing motion in the solid material in dependence on an applied shear stress. One of the curves describes purely Newtonian behavior, in which there is a constant ratio between shear stress and shear rate, or viscosity, over the entire range under consideration. As a departure from this, the other curve shown comprises, for example, a primary shear stress, which first has to be exceeded before a shearing motion occurs. The greater the viscosity of a material, the better it can be mechanically conveyed. Conversely, difficulties occur in the discharge of solid material if the phase to be discharged is of a particularly low viscosity.

If the solid material has a low viscosity, under some circumstances it is possible to compensate for this by a correspondingly high differential speed. However, this method leads to different disadvantages, such as making it difficult for a decanter to be used for such separating tasks. Examples of these are extraction of pectins, extraction of lysine, thickening of surplus pulp, and beer recovery from spent yeast.

The present disclosure relates, for example, to the processing of these types of products.

Operational experience has shown that, in applications for the just-mentioned types of products, for example, it is scarcely possible in mechanical terms to achieve, in particular, the radial conveyance in the cone counter to the centrifugal effect.

To solve the problem of discharging relatively low-viscosity solid phases, it has been proposed in U.S. Pat. No. 5,244,451 to blow compressed air into the solid phase in the region of the cone, in order to reduce the average density of the solid phase. This has the effect that the solid material is forced inward and in the direction of the solid-material discharge openings at the conical end of the drum. Disadvantageous from aspects of such a structural design and process engineering are, in particular, the high pressures to be applied, which are 10 to 15 bar.

It is proposed in U.S. Pat. No. 3,885,734 to admit gas directly to the separation space. However, a disadvantage of this is that, although it may be possible after the pressurization for solid materials to be discharged, it is not possible to achieve a constantly improved discharge of solid material in stationary operation.

Against this background, the present disclosure relates to a solid-bowl screw centrifuge and a process for operating the solid-bowl screw centrifuge that makes it possible for relatively low-viscosity solids to be discharged.

The present disclosure relates to a solid-bowl centrifuge and a process for operating the centrifuge. The solid-bowl centrifuge includes a rotatable drum having a horizontal axis of rotation. The rotatable drum surrounds a centrifuging space and includes at least a tapering portion. A screw is arranged in the drum and the screw is rotatable at a differential speed in relation to the drum. At least one solid-material discharge is located in the tapering portion of the drum. An immersion disk is located on the screw. The disk lies between a liquid feed and the solid-material discharge and subdivides the centrifuging space into a discharge space located between the immersion disk and the solid-material discharge and a separating space located between the immersion disk and a liquid discharge. Also included is a device for admitting a gas to the separation space, wherein the liquid discharge is sealed from its surroundings in such a way that a liquid level R1 of a pond in a region of the separation space remains unchanged when pressurization occurs. The process for operating the solid-bowl centrifuge, comprises the following processing steps: providing a solid-bowl centrifuge that includes the following: a rotatable drum having a horizontal axis of rotation, the rotatable drum surrounding a centrifugal space and having a tapering portion; a screw arranged in the drum and rotatable at a differential speed in relation to the drum; at least one liquid discharge which is sealed from its surroundings; at least one solid-material discharge located in the tapering portion of the drum; an immersion disk on the screw, which disk lies between a liquid feed and the at least one solid-material discharge, the immersion disk subdividing the centrifuging space into a discharge space between the immersion disk and the at least one solid-material discharge and a separating space between the immersion disk and the at least one liquid discharge; and, a device to admit gas to the separation space; feeding a material to be centrifuged into the centrifuge via an inlet tube; operating the centrifuge; applying pressure to the separation space via a feed line wherein a level of a pond in a region of the separation space remains unchanged.

If a pressure other than ambient pressure is imposed on the separation or centrifuging space, i.e. the space in which the separation or decantation takes place, an inside diameter of the solid material that is dependent on the difference in pressure will be established in the conical discharge space. That is so since the liquid discharge is hermetically sealed from the ambient pressure in such a way that, in interaction with the baffle, the inside diameter or level of the pond in the region of the separation space remains unchanged when there is an increase in pressure in stationary operation. This is not the case in document U.S. Pat. No. 3,885,734 where the separation space is in connection with the ambient pressure at the liquid discharge via communicating tubes. Thus, when there is an increase in pressure there is a shift in the liquid level in the separation space, which has the consequence that the discharge of solid material is not permanently improved during operation. In accordance with the present disclosure, on the other hand, the sealing of the liquid discharge takes place by a peeling disk or by some other sealing means, for example, a hydrohermetic chamber, which is designed such that the pressurization does not lead to a shift in the level in the separation space.

If an inside diameter of the liquid phase is less than a diameter of the solid-material discharge of the drum, low-viscosity solid material is also conveyed out of the drum. If the inside diameter is greater, there is no solid-material discharge. In order to carry such solid material away, it is generally necessary to apply a pressure of 0 to 10 bar, or, for example, 0.5 bar or more, or, for example, 0.5 to 5 bar, to the separation space.

The device for admitting a gas to the separation space has a feed line into the separation space, which during operation opens out into the separation space on a radius that is less than the radius of the liquid level during operation.

The gas may be compressed air, which may be sterile air, or, for example, nitrogen.

The present disclosure also relates to optical measurement of the torque between the drum and the screw, which is a measure of the degree of filling with solid material in the decanter. The optical measurement signal is fed to the pressure control unit and evaluated and used as a control signal for a setpoint value of the imposed pressure. The differential speed between the screw and the drum thereby remains constant. It is possible, in accordance with the present disclosure, to dispense with a secondary drive for changing the differential speed. Rather, this remains constant. The actual control of the process, on the other hand, takes place in a way by variation of the pressure in the separation space. The separation space is measured by a further line.

In an embodiment of the present disclosure, the amount of solid-material discharge is controlled or regulated by variation of the pressure in the separation space.

Embodiments, according to the present disclosure, include, for example, the following advantages. Monitored metering of the conveyance of solid material in the decanter even in the case of solid-material compositions which, in mechanical terms, cannot be conveyed, or only with difficulty. A possible cost saving obtained by dispensing with the secondary drive. No influence on the conveyance of solid material by the so-called idling torque, which is dependent on the high differential speed. Rather, it is conceivable, according to the present disclosure, for the differential speed, and consequently the idling torque, to be kept constant. The solid material can be drawn off over a small diameter.

The admission of a gas to the separation space offers an optional way of imposing a protective gas on the sedimentation pond.

Other aspects of the present disclosure will become apparent from the following descriptions when considered in conjunction with the accompanying drawings.

DETAILED DESCRIPTION

Figure 1:
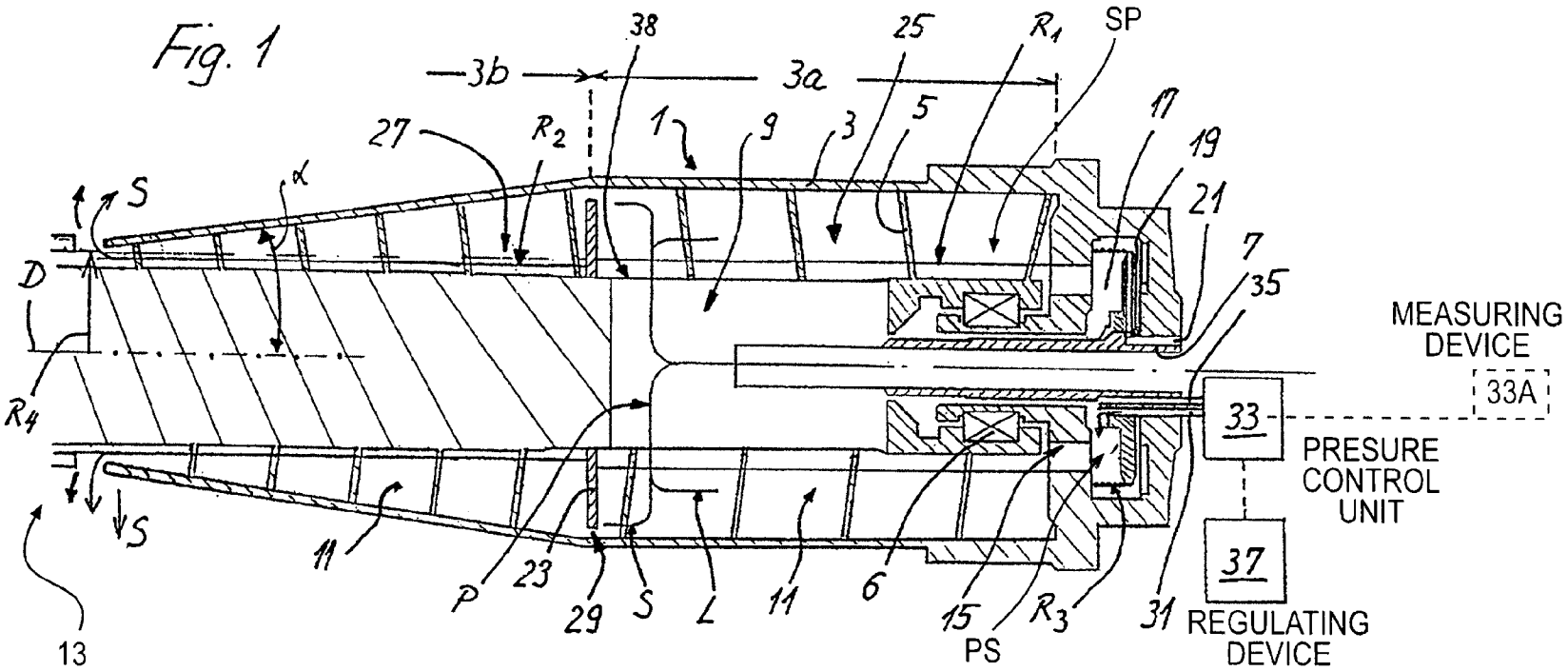
FIG. 1 shows a section of a solid-bowl screw centrifuge, according to the present disclosure.
Figure 2:
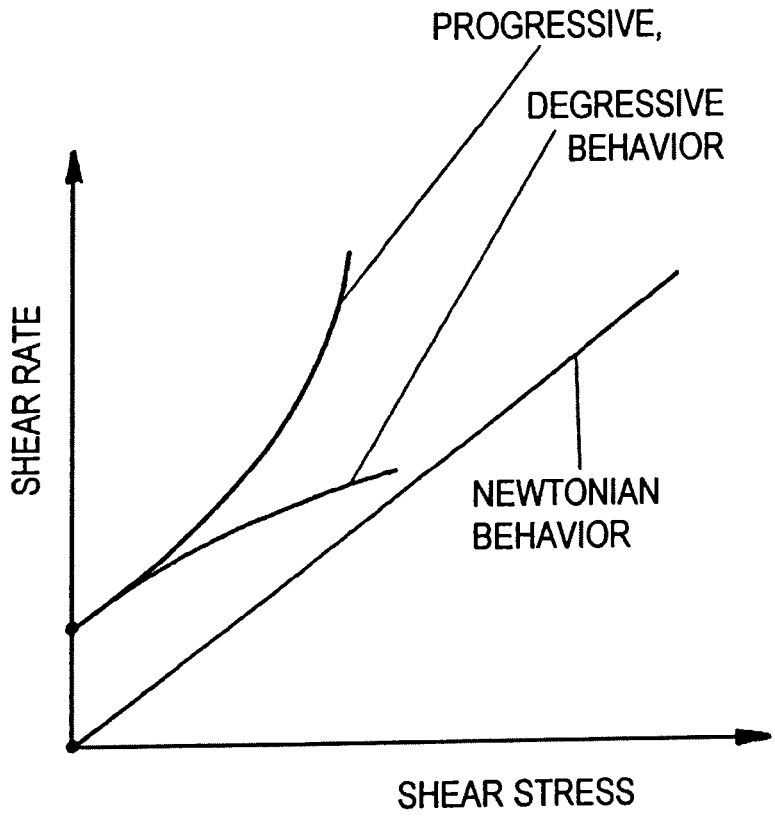
FIG. 2 shows a diagram illustrating the shearing behavior of solid-material compositions.

FIG. 1 shows a solid-bowl screw centrifuge 1 including a drum 3 having a horizontal axis of rotation D, in which drum 3 a screw 5 is arranged. The drum 3 and, for example, the screw 5, have a substantially cylindrical portion 3*a* and a tapering portion 3*b*. The tapering portion 3*b* tapers conically.

An axially extending central inlet tube 7 serves for feeding a material to be centrifuged P into the centrifuging space 11 between the screw 5 and the drum 3 via a distributor 9, which distributor 9 is shown perpendicular to the inlet tube 7. The distributor 9 includes a liquid feed 38 into the centrifuging space 11.

If, for example, a sludgy slurry is introduced into the drum 3, particles of solid material are deposited on a drum wall. Further toward the inside, there forms a liquid phase L.

The screw 5, mounted by the bearing 6, rotates at a somewhat lower or greater speed than the drum 3 and conveys centrifuged solid material S to the conical tapered portion 3*b*, to a solid-material discharge 13.

The liquid or liquid phase L, on the other hand, flows toward a greater drum diameter at a rear end of the cylindrical portion 3*a* of the drum 3, where the liquid L is passed through a weir 15 into a chamber 17. Chamber 17 axially adjoins the actual centrifuging space 11. Arranged in centrifuging space 11 is a peeling disk 19 for draining away the liquid phase L, which peeling disk 19 has one or more draining channels 21, through which the liquid phase L is drained out of the drum 3.

The peeling disk 19 may be arranged directly on the inlet tube 7, which is stationary during operation. It is possible, for example, to realize a sealed gap-free arrangement between the peeling disk 19 and the inlet tube 7.

The liquid discharge via peeling disk 19 is formed in such a way that it is sealed from the ambient pressure.

In a transitional region between the cylindrical portion 3*a* and the conical portion 3*b*, the screw 5 has or includes an immersion disk 23 ahead of the solid-material discharge 13. The immersion disk 23 extends from the screw 5 radially outward into the centrifuging space 11 and is immersed in a liquid level R1.

The immersion disk 23 is fitted axially to an end on a solid-material side of the cylindrical portion 3*a* of the drum 3. The immersion disk 23 divides the overall drum space into a separation space 25 between the liquid discharge, or peeling disk 19 and the immersion disk 23 and a discharge space 27, which may have a conical shape, between the solid-material discharge 13 and the immersion disk 23.

The immersion disk 23 may also be fitted in the conical portion 3*b*. The immersion disk 23 is arranged between the solid-material discharge 13 and the liquid feed 38.

Moreover, a diameter, or radius, of the immersion disk 23 is configured to be greater than a radius or diameter R4, depending upon where the measurement is made from, up to which the solid-material discharge 13 extends as a maximum. R4 is shown in FIG. 1 measured as a radius from center line or axis of rotation D.

An outer contour of the immersion disk 23 forms, with the inner wall of the drum 3, an annular gap, or immersion disk gap 29, through which the solid material passes from the separation space 25 to the solid-material discharge 13. An end on a liquid side of the separation space 25 is sealed from its surroundings, which can be realized, for example, by the internal peeling disk 19 with a drainage diameter or radius R3, depending on where the measurement is made from, or a hydrohermetic chamber arranged upstream of the liquid discharge 19, in order to prevent a free exchange of gas between the separation space 25 and its surroundings. The combination of the immersion disk 23 and the sealed liquid discharge or internal peeling disk 19 has the effect that the separation space 25, in which the separation takes place, is thereby hermetically sealed from the surroundings or the surrounding atmosphere of the peeling disk 19.

A device for admitting a gas to the separation space 25 includes a feed line 31 leading into the centrifuge 1 from the outside. The feed line 31 may be, for example, a bore parallel to the inlet tube 7 on the outer circumference of the inlet tube 7. That makes it possible for a gas to be fed into the separation space 25, for example, via a pressure control unit 33. A further line or bore 35 makes it possible to measure a pressure PS in the separation space 25 by a suitable measuring device 33A, which may be integrated in the pressure control unit 33. The pressure control unit 33 is, in turn, connected to a controlling or regulating device 37 for controlling or regulating the decanter 1.

The feed line 31 makes it possible for the pressure in the separation space 25 of the drum 3 to be varied.

A system in operation, including the solid-bowl centrifuge 1 according to the present disclosure, is schematically represented in FIG. 1. In the separation space 25 there forms an annular suspension pond SP. The liquid discharge via peeling disk 19 is thereby hermetically sealed from the ambient pressure in such a way that the inside diameter or level R1 of the annular suspension pond SP in the region of the separation space 25 remains unchanged when there is an increase in pressure from gas entering via feed line 31. Diameter or radius R1, depending upon where the measurement is made from, corresponds substantially to a regulating diameter or radius. On the other hand, ambient pressure prevails in the conical discharge space 27.

If a pressure other than ambient pressure is then applied to the separation space 25 via the line 31, an inside diameter or radius R2, depending upon where the measurement is made from, of the solid phase S, that is dependent on the difference in pressure, will be established in the conical discharge space 27. If this inside diameter or radius R2 is less than the solid-material discharge diameter or radius R4, that is to say, the diameter or radius over which solid-material discharge openings lie, a solid-material discharge S takes place even for a very low-viscosity liquid phase.

A conicity angle $\alpha$ between a longitudinal axis, or approximately the axis of rotation D of the drum 3 and the conical portion 3*b* is, for example, 10° to 90°, or may be more than 15°, or may be more than 30°. In accordance with an embodiment of the present disclosure having a centrifuge 1 with a conical design, a relatively large conicity angle $\alpha$ is conceivable and advantageous in that the drum 3 is very short in an axial sense. In a case of a 90° angle, the drum 3 with a conical portion becomes an entirely cylindrical drum.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A solid-bowl screw centrifuge comprising:

a rotatable drum having a horizontal axis of rotation, the rotatable drum surrounding a centrifuging space and including at least a tapering portion;

a screw is arranged in the drum, the screw being rotatable at a differential speed in relation to the drum;

at least one solid-material discharge located in the tapering portion of the drum;

an immersion disk on the screw, which disk lies between a liquid feed and the solid-material discharge and subdivides the centrifuging space into a discharge space located between the immersion disk and the solid-material discharge and a separating space located between the immersion disk and a liquid discharge;

a device for admitting a gas to the separation space, the device including a pressure control unit and a regulating device to measure and control a pressure in the separation space; and wherein the liquid discharge is sealed from its surroundings in such a way that when gas pressure is admitted under measurement and control of the pressure control unit and the regulating device, a level R1 of a pond SP in a region of the separation space remains unchanged when the pressurization occurs via the gas entering the separation space via a feed line.

2. The solid-bowl screw centrifuge as claimed in claim 1, wherein the device for admitting a gas to the separation space includes the feed line into the separation space, which feed line, during operation, opens out into the separation space on a radius that is less than the radius of the liquid level R1.

3. The solid-bowl screw centrifuge as claimed in claim 1, wherein the device for admitting a gas to the separation space is connected to the feed line into the separation space.

4. The solid-bowl screw centrifuge as claimed in claim 1, wherein the measuring device measures the pressure in the separation space by a bore into the separation space.

5. The solid-bowl screw centrifuge as claimed in claim 1, the drum further including a cylindrical portion and wherein the immersion disk is arranged on the screw in a transitional region between the tapering portion and the cylindrical portion of the drum.

6. The solid-bowl screw centrifuge as claimed in claim 1, wherein the immersion disk has a radius which is greater than a radius, R4 up to which the solid-material discharge extends as a maximum.

7. The solid-bowl screw centrifuge as claimed in claim 1, wherein an end on a liquid side of the separation space is sealed from its surroundings.

8. The solid-bowl screw centrifuge as claimed in claim 1, wherein the liquid discharge includes and takes place by at least one peeling disk.

9. The solid-bowl screw centrifuge as claimed in claim 1, further comprising a hydrohermetic chamber is arranged upstream of the liquid discharge.

10. The solid-bowl screw centrifuge as claimed in claim 1, wherein the tapering portion is a conically formed portion.

11. The solid-bowl screw centrifuge as claimed in claim 10, wherein a conicity angle $\alpha$ between the horizontal axis of the drum and the conical portion is 10° to 90°.

12. The solid-bowl screw centrifuge as claimed in claim 10, wherein ambient pressure prevails in the discharge space.

13. The solid-bowl screw centrifuge of claim 10, wherein a conicity angle $\alpha$ between the horizontal axis of the drum and the conical portion is more than 15°.

14. The solid-bowl screw centrifuge of claim 10, wherein a conicity angle $\alpha$ between the horizontal axis of the drum and the conical portion is more than 30°.

15. A process for operating a solid-bowl centrifuge, the process steps comprising:

providing a solid-bowl centrifuge that includes a rotatable drum having a horizontal axis of rotation, the rotatable drum surrounding a centrifugal space and having a tapering portion, a screw arranged in the drum and rotatable at a differential speed in relation to the drum, at least one liquid discharge which is sealed from its surroundings, at least one solid-material discharge located in the tapering portion of the drum, an immersion disk on the screw, which disk lies between a liquid feed and the at least one solid-material discharge, the immersion disk subdividing the centrifuging space into a discharge space between the immersion disk and the at least one solid-material discharge and a separating space between the immersion disk and the at least one liquid discharge, and a device to admit gas to the separation space;

feeding a material to be centrifuged into the centrifuge via an inlet tube;

operating the centrifuge;

applying pressure to the separation space via a feed line wherein a level of a pond in a region of the separation space remains unchanged; and further comprising the process steps of keeping constant a differential speed between the screw and the drum and providing a pressure control unit to measure a torque between the drum and the screw, which torque is used as a measure of a degree of filling of solid material in the drum, wherein the measurement of the pressure control unit is evaluated and used as a control signal for a set-point value of the applied pressure.

16. The process as claimed in claim 15, wherein the applied pressure to the separation space via the feed line is an applied pressure that is other than ambient pressure.

17. The process as claimed in claim 15, wherein the applied pressure is between 0 and 10 bar.

18. The process as claimed in claim 15, wherein the applied pressure is between 0.5 and 5 bar.

19. The process as claimed in claim 15, wherein the applied pressure to the separation space is measured via a bore.

20. The process as claimed in claim 15, wherein the applied pressure in the separation space is set in such a way that a level R2 of a solid phase in the discharge space is less than a solid-material discharge level R4, at which level R4 the solid-material discharge of the drum lies.

21. The process as claimed in claim 15, wherein an amount of discharged solid-material is controlled by a variation of the applied pressure in the separation space.

* * * * *